US006879905B2

(12) United States Patent
Koseki et al.

(10) Patent No.: US 6,879,905 B2
(45) Date of Patent: Apr. 12, 2005

(54) APPARATUS AND A METHOD FOR CONTROLLING AN ENGINE

(75) Inventors: Takahisa Koseki, Yokohama (JP); Tetsuya Iwasaki, Tokyo (JP); Takashi Nakazawa, Kawasaki (JP); Masahiko Yuya, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/329,785

(22) Filed: Dec. 27, 2002

(65) Prior Publication Data

US 2003/0121487 A1 Jul. 3, 2003

(30) Foreign Application Priority Data

Dec. 28, 2001 (JP) ..... 2001-400182

(51) Int. Cl.[7] ..... F02D 41/06; F02N 11/08

(52) U.S. Cl. ..... 701/113; 123/406.53; 123/491; 123/179.18

(58) Field of Search ..... 123/406.53, 406.54, 123/491, 179.1, 179.16, 179.17, 179.18; 701/113

(56) References Cited

U.S. PATENT DOCUMENTS 4,681,079 A * 7/1987 Kaneta ..... 123/491
4,683,859 A * 8/1987 Tamura et al. ..... 123/491
5,970,936 A * 10/1999 Cabrera et al. ..... 123/179.3
6,438,487 B1 * 8/2002 Mingo et al. ..... 701/113

FOREIGN PATENT DOCUMENTS

JP 9-170534 A 6/1997

* cited by examiner

*Primary Examiner*—Andrew M. Dolinar
(74) *Attorney, Agent, or Firm*—Foley & Lardner LLP

(57) ABSTRACT

Engine cranking control is ended when it is detected that the battery voltage for driving the starter is lowered to at least as low as a starter drive judgment value and thereafter, returns to at least a starter stop judgment value during the engine cranking control that is started on condition that an engine is rotating. A start for driving a starter and a stop of driving the starter can be distinguished based on battery voltage where the battery voltage recovers due to a rapid reduction of consuming current and a rapid increase of a generating current when a driver recognizes an engine combustion completion and stops a starter driving. As a result, on increase of an engine friction, the cranking control is accurately ended, preventing deterioration of a fuel economy and excess exhaust gas emission.

3 Claims, 10 Drawing Sheets

APPARATUS AND A METHOD FOR CONTROLLING AN ENGINE

FIELD OF THE INVENTION

The present invention relates to engine control; more especially, to performing engine cranking control for a proper amount of time when cranking is caused by an engine starter.

RELATED ART OF THE INVENTION

In an earlier vehicle engine, in order to ensure an engine start performance by shortening an engine cranking period, control actions such as fuel injection, ignition timing and air quantity inherent for engine cranking are performed during a cranking period based upon detection of cranking.

The cranking period is detected by inputting a starter switch signal attached to an ignition key cylinder to an engine control unit (ECU). For this detection, a harness from a starter switch to an input terminal of the ECU has been used, which increases costs. Therefore, in another earlier technology, the start of engine rotation is judged as when an engine rotation signal is input from a crank angle sensor and then, the engine cranking control is started. Thereafter, when the engine reaches above a predetermined rotation velocity, the cranking control ends.

However, if engine friction becomes large in a cold engine, or if a generating torque lowers due to failures of ignition components and fuel components, a rotation increase velocity becomes slow. As a result, it takes too long to reach a predetermined rotation velocity leading to self-rotation of the engine, or the engine does not reach the necessary predetermined rotation velocity.

In this case, the time for performing cranking control becomes longer than when the cranking control is performed only during a period in which the starter switch is on, thereby making an ignition plug wet due to too much fuel and deteriorating combustion stability.

Therefore, a battery voltage immediately prior to a starter driving is stored and when a current value of the battery voltage becomes larger, the starter stops. When the battery voltage does not increase even if the starter stops, the starter continues to switch on for a predetermined time to avoid expending the battery (Japanese Unexamined Patent Publication No. 9-170534).

SUMMARY OF THE INVENTION

Since the starter forcibly stops before an engine combustion completion (where the engine can rotate by its own combustion force) in the above technology, the engine can not be cranked. This works against a driver's start operation.

One aspect of the present invention, in view of the foregoing problem, performs an engine cranking control on an engine without using a starter switch signal and ends the engine cranking control at an optimal time.

Therefore, the present invention ends the engine cranking control if at least one of the following events occurs during engine cranking control that is started when the engine is rotating:

(i) the battery voltage is lowered to at least as low as a starter drive judgement value, and then, the battery voltage is raised to at least as high as a starter stop judgement value, wherein the starter drive judgement value is greater than the starter stop judgement value;

(ii) a predetermined elapse time elapses starting when the engine cranking control is started, which predetermined elapse time elapses before battery voltage is raised to the starter stop judgement value; and (iii) a setting time representing a time that the engine rotation is not detected elapses, wherein the setting time is less than the predetermined elapse time.

These and other aspects, and features of this invention will be understood from the following description with accompanying drawings.

DETAILED DESCRIPTION OF THE PREFERRED EMBODIMENTS OF THE INVENTION

Selected preferred embodiments of the present invention will be explained with reference to the drawings. It will be apparent to those skilled in the art from this disclosure that the following description of the embodiments of the present invention is provided for illustration only, and not for the purpose of limiting the invention as defined by the appended claims and their equivalents.

Figure 1:
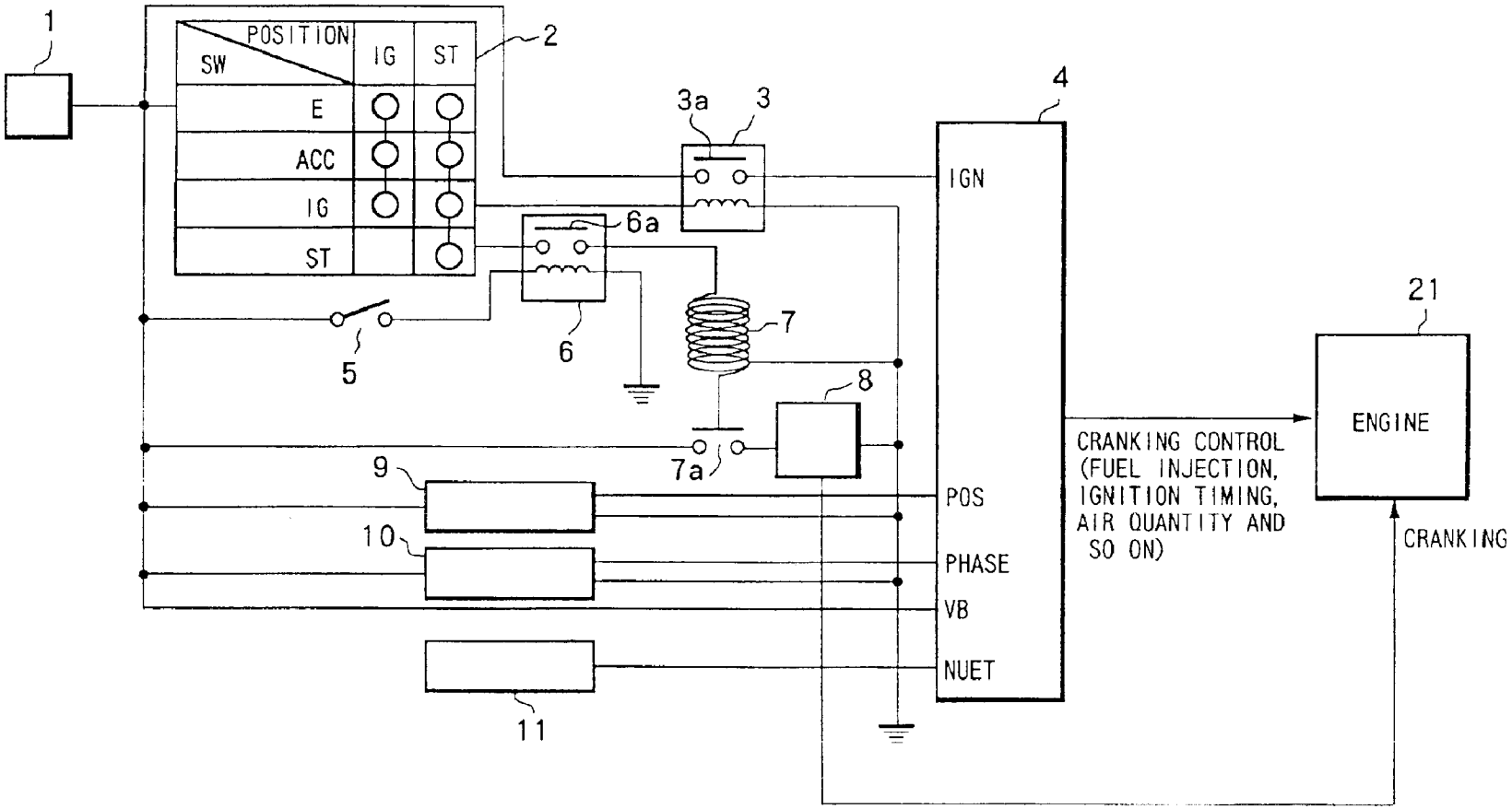
FIG. 1 is a block circuit view of an engine cranking control apparatus according to the invention.

FIG. 1 shows a block circuit structure of an engine cranking control apparatus of an engine according to the invention. A key switch 2 of an engine 21 is connected to a battery 1. When key switch 2 is placed at an ignition position IG or a start position ST, power is supplied to an ignition relay 3 and a contact point 3*a* in relay 3 switches on. As a result, an ignition signal is input to an ignition terminal IGN to an engine control unit ECU or controller 4 to drive an ignition circuit.

An inhibitor switch 5 which is on at a neutral position of an automatic transmission (or, alternatively, a clutch interlock switch which is on at a clutch release state of a manual transmission) is connected to battery 1. When inhibitor switch 5 is on, namely, at a neutral position, power is supplied to starter relay 6 connected to inhibitor switch 5 and a contact point 6*a* in starter relay 6 switches on. When key switch 2 is set at the start position in this state, power is supplied to a second relay switch 7 through contact point 6*a* and a contact point 7*a* of relay 7 switches on to drive a starter 8. As a result, engine 21 is cranked.

Further, a crank angle sensor 9 and a cam sensor 10 are connected to battery 1. Crank angle sensor 9 outputs a position (POS) signal for each unit crank angle (for example, 10 degrees) during rotation of engine 21. Cam sensor 10 outputs a PHASE signal for cylinder identification in synchronization with rotation of a cam shaft which drives an intake valve and an exhaust valve of engine 21. These signals are input to a POS terminal and a PHASE terminal, respectively, of ECU 4. ECU 4 detects an engine rotation velocity Ne and a crank angle position based upon the POS signal and the PHASE signal to identify a cylinder, as well as to judge a cranking period.

ECU 4, based upon this judgement, performs an engine cranking control such as fuel injection, ignition timing, and air quantity control to engine 21 during the cranking period. Further, a voltage VB signal from battery 1 is input to a VB terminal of ECU 4 where a battery detection unit (battery detector) detects a battery voltage value. A neutral signal from a neutral switch 11 is input to a NUET terminal of ECU 4.

The engine cranking control based upon the cranking period judgement will be explained according to flowcharts in FIG. 2–FIG. 5 with reference to a time chart shown in FIG. 6.

Figure 2:
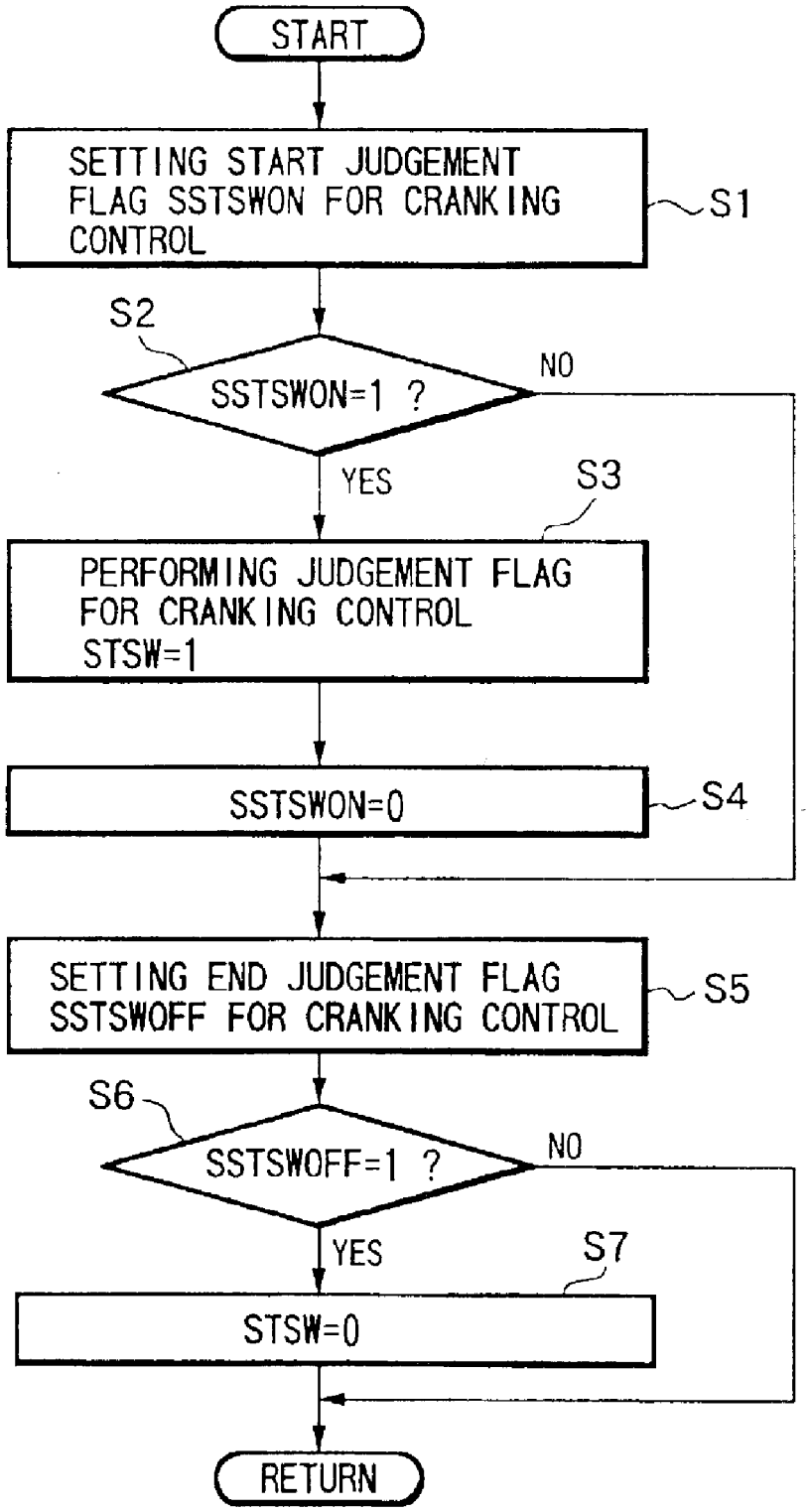
FIG. 2 is a flowchart showing a main routine of engine cranking control performed by the engine cranking control apparatus.

FIG. 2 shows a main routine for the engine cranking control. This flow is periodically executed at a predetermined cycle (for example, every 10 ms). At step S 1, a value of a start judgement flag SSTSWON for the engine cranking control is set. This setting is explained in more detail below.

At step S 2, it is judged whether or not the value of the flag SSTSWON is set as 1. If the value of the flag SSTSWON is 1, the process goes to step S 3, wherein a performing judgement flag STSW for the engine cranking control is set as 1, and then at step S 4, the value of the flag SSTSWON is reset as 0.

Thereafter, the process goes to step S 5, wherein the value of an end judgement flag SSTSWOFF for the engine cranking control is set.

Also, at step S 2, if the value of the flag SSTSWON is 0, the process moves directly to step S 5, where a value of the end judgement flag SSTSWOFF for the engine cranking control is set. A setting method for the value of the flag SSTSWOFF is explained below. At step S 6, it is judged whether or not the value of the end judgement flag SSTSWOFF for the engine cranking control is 1. When the value is 1, the process goes to step S 7, wherein, after the value STSW is reset as 0, the routine ends. At step S6, if the end judgment flag SSTSWOFF is 0, the routine bypasses step S7 and ends.

Figure 3:
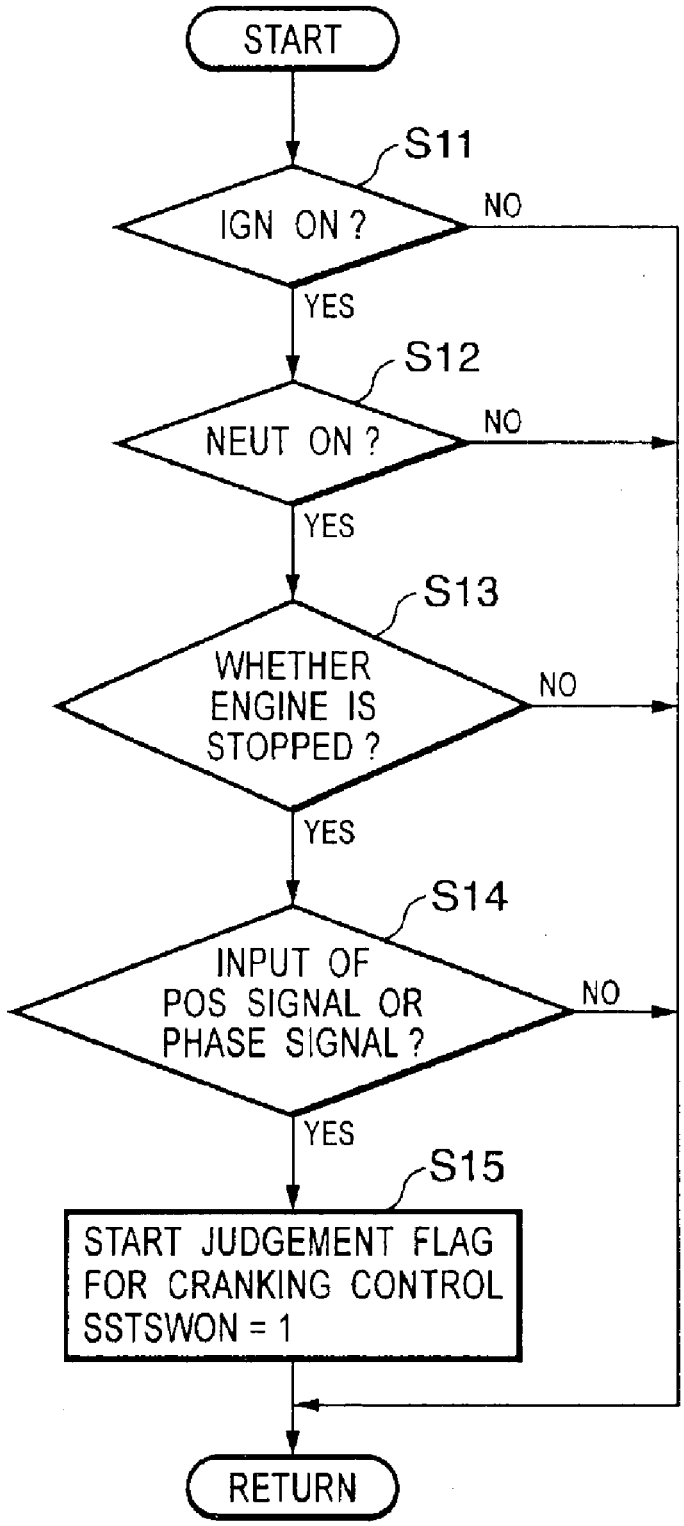
FIG. 3 is a flowchart showing a routine setting a start judgement flag for the engine cranking control.

Next, a routine for setting the value of the start judgement flag SSTSWON for the engine cranking control will be explained in reference to FIG. 3. At step S 11, it is judged whether or not an ignition switch is on, and at step S12, it is judged whether or not neutral switch 11 is on. When both switches are on, the process goes to step S 13, wherein the routine determines whether or not engine rotation velocity Ne calculated based upon the POS signal is 0.

If the engine rotation velocity Ne is 0, it is judged whether or not the POS signal or the PHASE signal is input at step S 14. When the input exists, the process goes to S 15, wherein the value of the start judgement flag SSTSWON for the engine cranking control is set as 1.

Thus, by detecting the start of engine rotation from an engine stopped condition, engine cranking control can be started.

When all answers to the judgements at steps S 11–S14 are negative, the value SSTSWON of the start judgement flag for the cranking control remains as 0 and the cranking control is not started.

Figure 4:
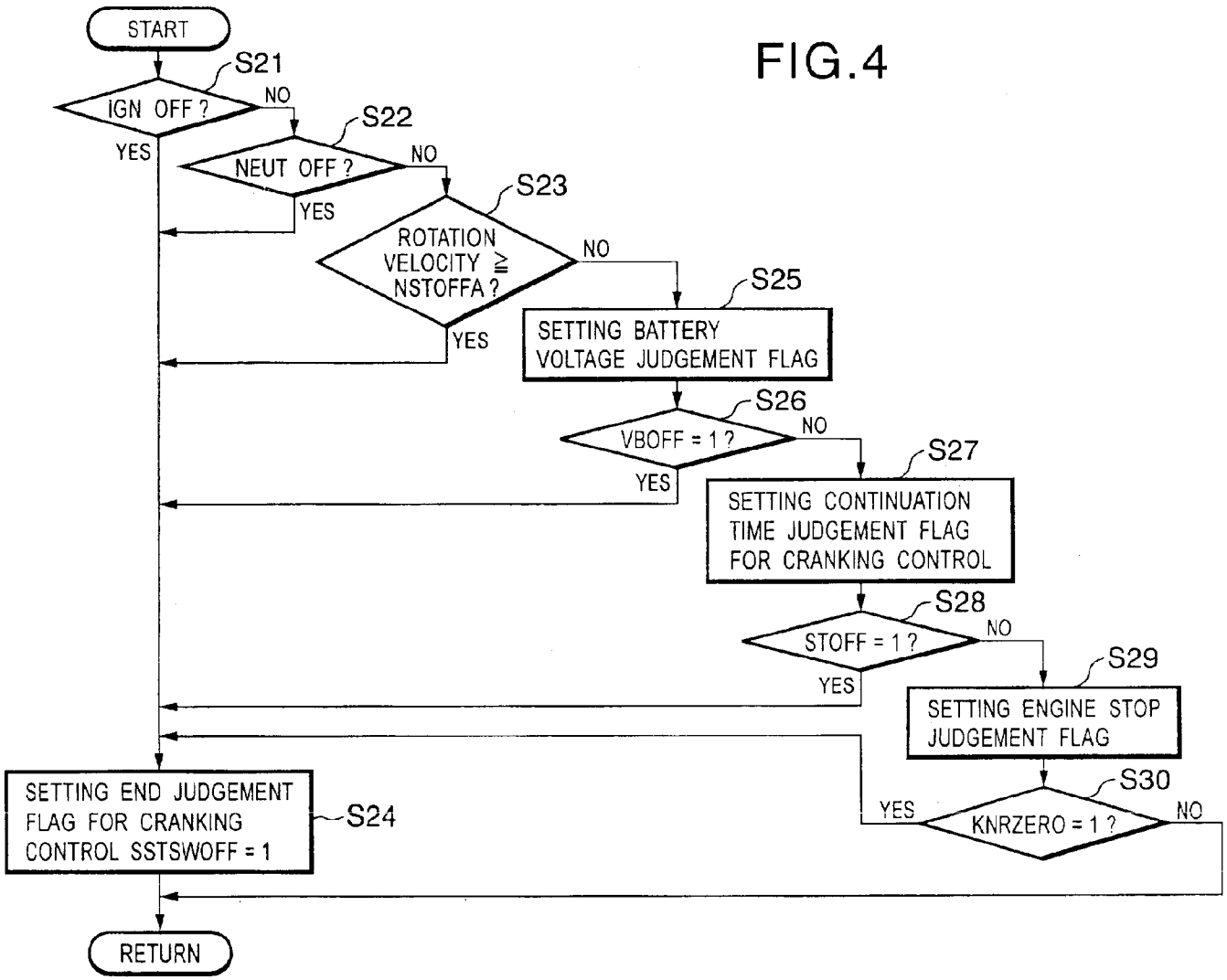
FIG. 4 is a flowchart showing a routine setting an end flag for the engine cranking control.

FIG. 4 shows a routine for setting the value SSTSWOFF of an end judgement flag for the engine cranking control according to the present invention.

At step S 21, it is whether or not the ignition switch is off. At step S 22, it is judged whether or not neutral switch 11 is off. At step S 23, it is judged whether or not the engine rotation velocity is equal to or greater than a predetermined rotation velocity NSTOFFA that represents an engine combustion completion where the engine Ne can rotate by itself. When any of steps S 21–S23 is "yes", the process goes to step S 24, where the end judgement flag SSTSWOFF for the engine cranking control is set as 1 and the engine cranking control is forced to end without the following judgement routine.

Thus, when the ignition switch switches off and the neutral switch switches off, this creates a demand to end the cranking control. Therefore, the cranking control is promptly ended.

When the engine reaches the necessary rotation velocity at which the engine can rotate by itself after the start of the cranking control, the cranking control is no longer necessary and the cranking control is ended, thereby preventing deterioration of fuel economy and preventing excess exhaust emission.

When each answer for steps S 21–S 23 is "no", namely, when the ignition switch and the neutral switch are both "on", and the engine rotation velocity Ne is below the predetermined rotation velocity STOFFA, the process goes to step S 25, where a value of the battery voltage judgement flag VBOFF is set. This setting method is explained in more detail below.

When, at step S 26, the battery voltage judgement flag VBOFF is 1, it is judged that the starter driving stops and the process goes to step S 24, where the end judgement flag SSTSWOFF for the cranking control is set as 1 and the engine cranking control ends. When, at step S 26, the battery voltage judgement flag VBOFF is 0, the process proceeds to step S 27, where the value of the continuation time judgement flag STOFF for the engine cranking control is set. This setting method will be explained in more detail below.

When, at step S 28, the continuation time judgement flag STOFF for the engine cranking control is 1, the process goes to step S 24, wherein the end judgement flag SSTSWOFF for the cranking control is set as 1 and the engine cranking control ends. When, at step S 28, the continuation time judgement flag STOFF is 0, the process proceeds to step S 29, where a value of an engine stop judgement flag KNRZERO is set. This setting method will be explained in more detail below.

When, at step S 30, the engine stop judgement flag KNRZERO is 1, the process moves to step S 24, where the end judgement flag SSTSWOFF for the cranking control is set as 1, and the engine cranking control ends.

Figure 5:
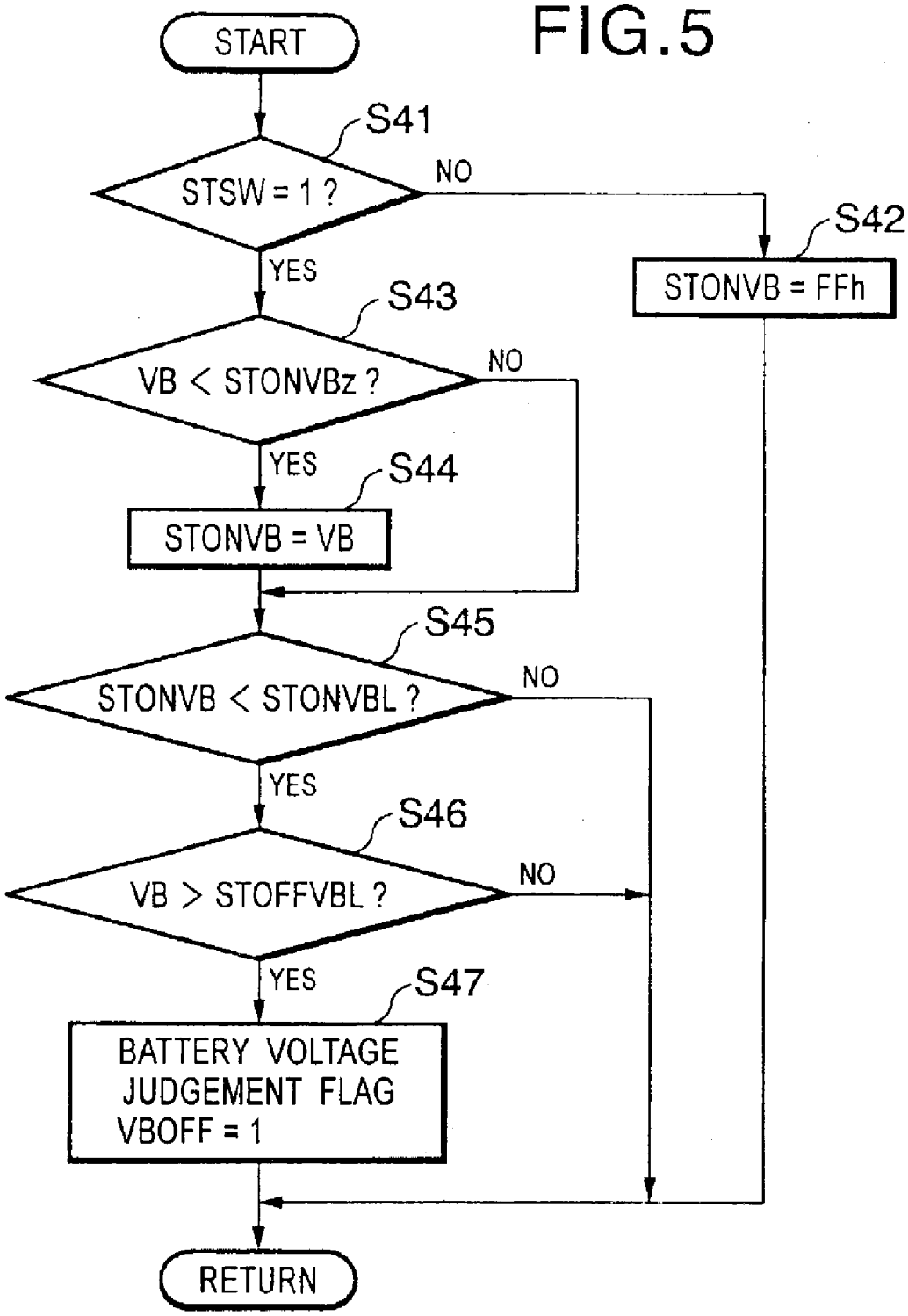
FIG. 5 is a flowchart showing a routine setting a battery voltage judgement flag for the engine cranking control.

FIG. 5 shows a routine for setting the value of the battery voltage judgement flag VBOFF.

At step S 41, it is judged whether or not a performing judgement flag STSW for the cranking control is 1. When the engine, before the start for the cranking control, is 0, the process goes to step S 42, wherein an initial value of a comparison value STONVB is set as a maximum value FFh. When the flag STSW is 1, the process goes to step S 43.

When, at step S 43, if a current battery voltage VB is less than a prior value STONVBz of the STONVB, the process moves to step S 44, where the STONVB is updated according to the battery voltage VB. Then the process proceeds to step S 45.

When, at S 43, the battery voltage VB is more than the prior value STONVBz, the process goes directly to step S 45, bypassing step S 44. Thereby, a minimum voltage of the battery is stored in STONVB.

At step S 45, if the minimum voltage STONVB is less than a starter drive judgement value STONVBL, the process goes to step S 46, where the routine determines if the current battery voltage VB exceeds a starter stop judgement value STOFFVBL. If VB exceeds the starter stop judgement value STOFFVBL, the process moves to step S 47, where the battery voltage judgement flag VBOFF is set as 1.

Figure 6:
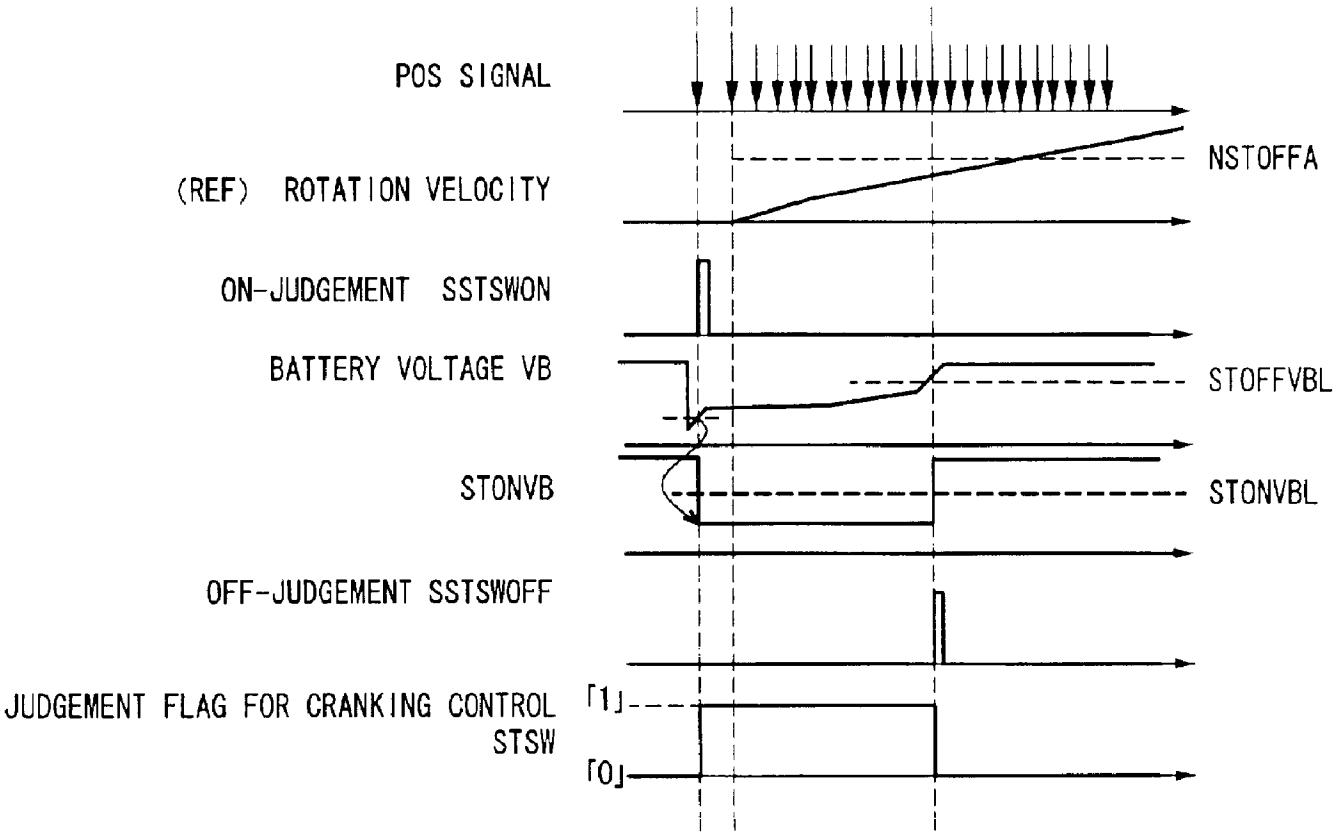
FIG. 6 is a time chart depicting when the battery voltage judgement flag is set.

FIG. 6 depicts a time chart showing the setting of the battery voltage judgement flag VBOFF as 1 based on a change of battery voltage, understood in connection with the above discussion.

A start of the starter driving and a stop thereof can be distinguished based upon the battery voltage VB lowering due to a rapid increase of a starter drive current that accompanies the starter driving, and the battery voltage recovers due to a rapid decrease of consumption current and a rapid increase of generation current when a driver recognizes an engine combustion completion of the cranking control and stops the starter driving.

As a result, the cranking control accurately ends when the engine rotation velocity increases slowly, or even when engine rotation velocity does not increase such as when the engine friction increases or the generation torque decreases due to a failure. Therefore, deterioration of fuel economy and excess exhaust gas emission is prevented.

For a vehicle with manual transmission, a clutch disengages before an engine rotation velocity increases and a starter driving is stopped by a clutch interlock. Thus, engine cranking control of the engine promptly ends and prevents a sudden start of the vehicle.

Figure 7:
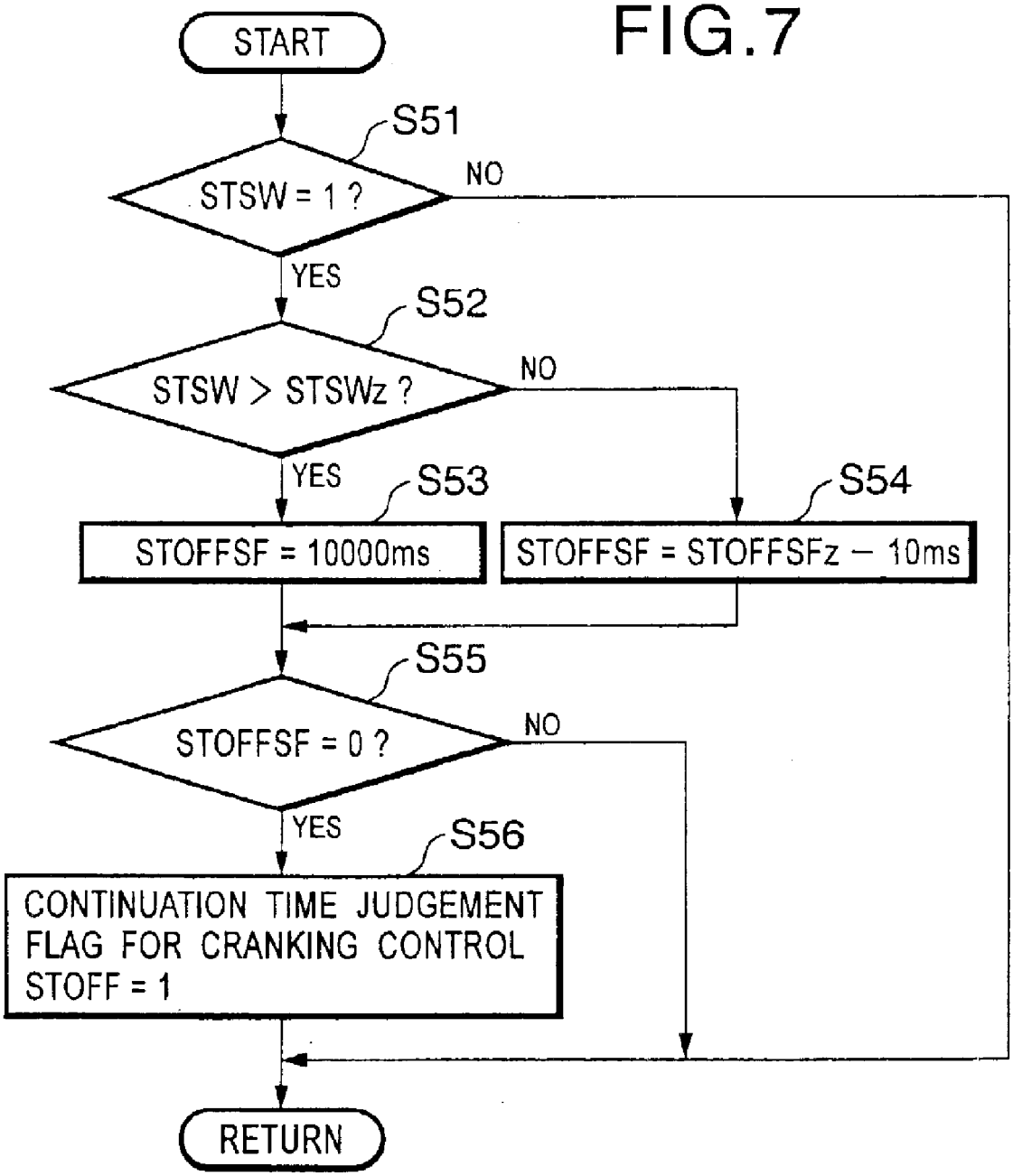
FIG. 7 is a flowchart showing a routine setting a continuation time judgement flag for the engine cranking control.

FIG. 7 shows a routine for setting a value of a continuation time judgement flag STOFF for cranking control.

When, at step S 51, a performing judgement flag STSW for the engine cranking control is 1, the process proceeds to step S 52, wherein it is judged whether the judgement flag STSW has just changed from 0 to 1. When judgment flag STSW is in a state immediate after changing to 1, the process goes to step S 53, where a timer STOFFSF is set, and which counts an elapse time after is set to an initial value (for example, 1000 ms). Thereafter, at step S 54, the initial value continues to be subtracted by a predetermined amount (for example, 10 ms).

As determined at step S55, when the timer STOFFSF becomes 0, namely, when the predetermined time elapses after starting the engine cranking control, the continuation time judgement flag STOFF for the cranking control is set as 1 at step S56.

Namely, if engine rotation velocity does not reach the predetermined value NSTOFFA due to an engine friction increase or due to a generation torque decrease because of failures of ignition and fuel components, and also the battery voltage VB does not reach the predetermined value STOFFVBL due to a failure of a battery charge system, the engine cranking control is ended within a predetermined time. Thereby, occurrence of an engine stall due to the ignition plug being wet due to too much fuel is prevented.

Figure 8:
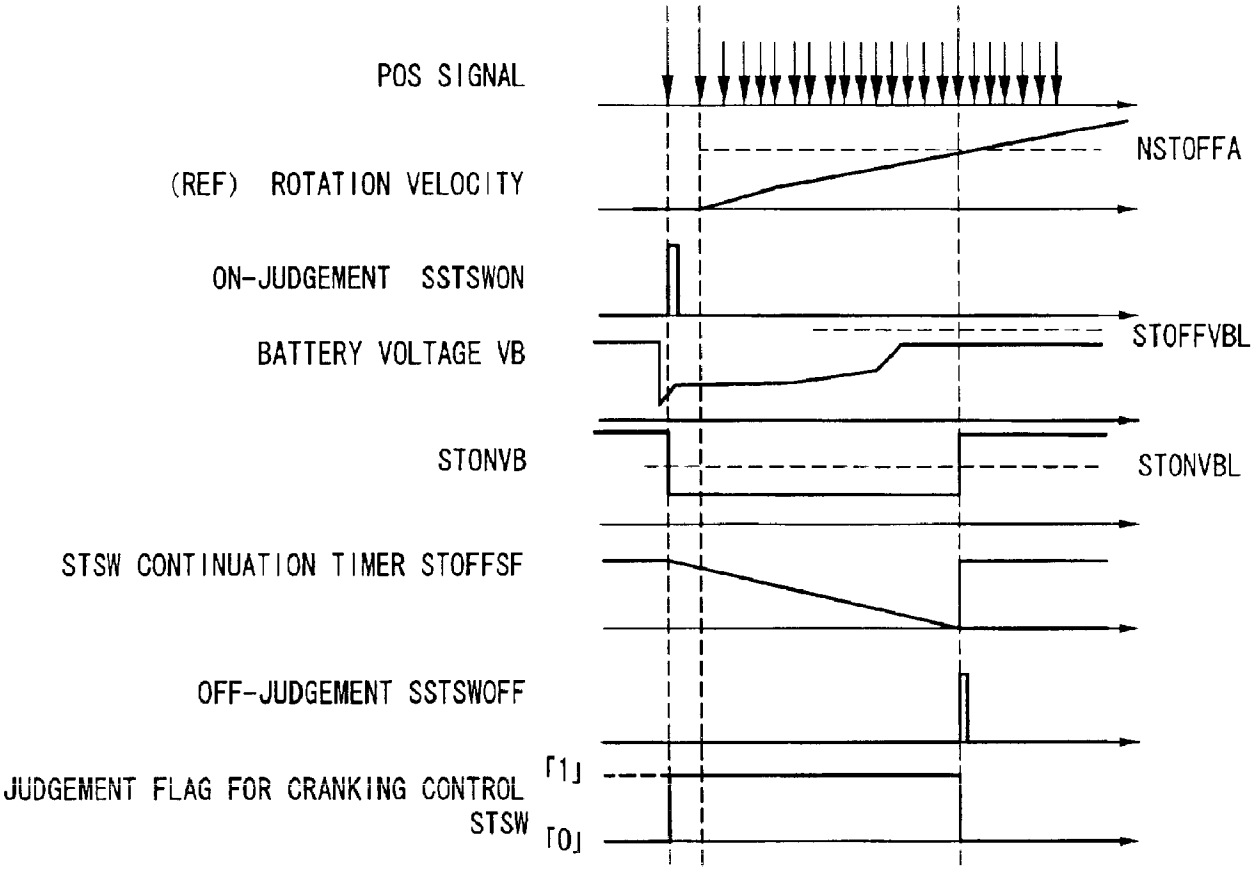
FIG. 8 is a time chart depicting when the continuation time judgement flag is set.

FIG. 8 is a time chart showing the continuation time judgement flag STOFF for the cranking control being set as 1 with the above-described time elapse.

Figure 9:
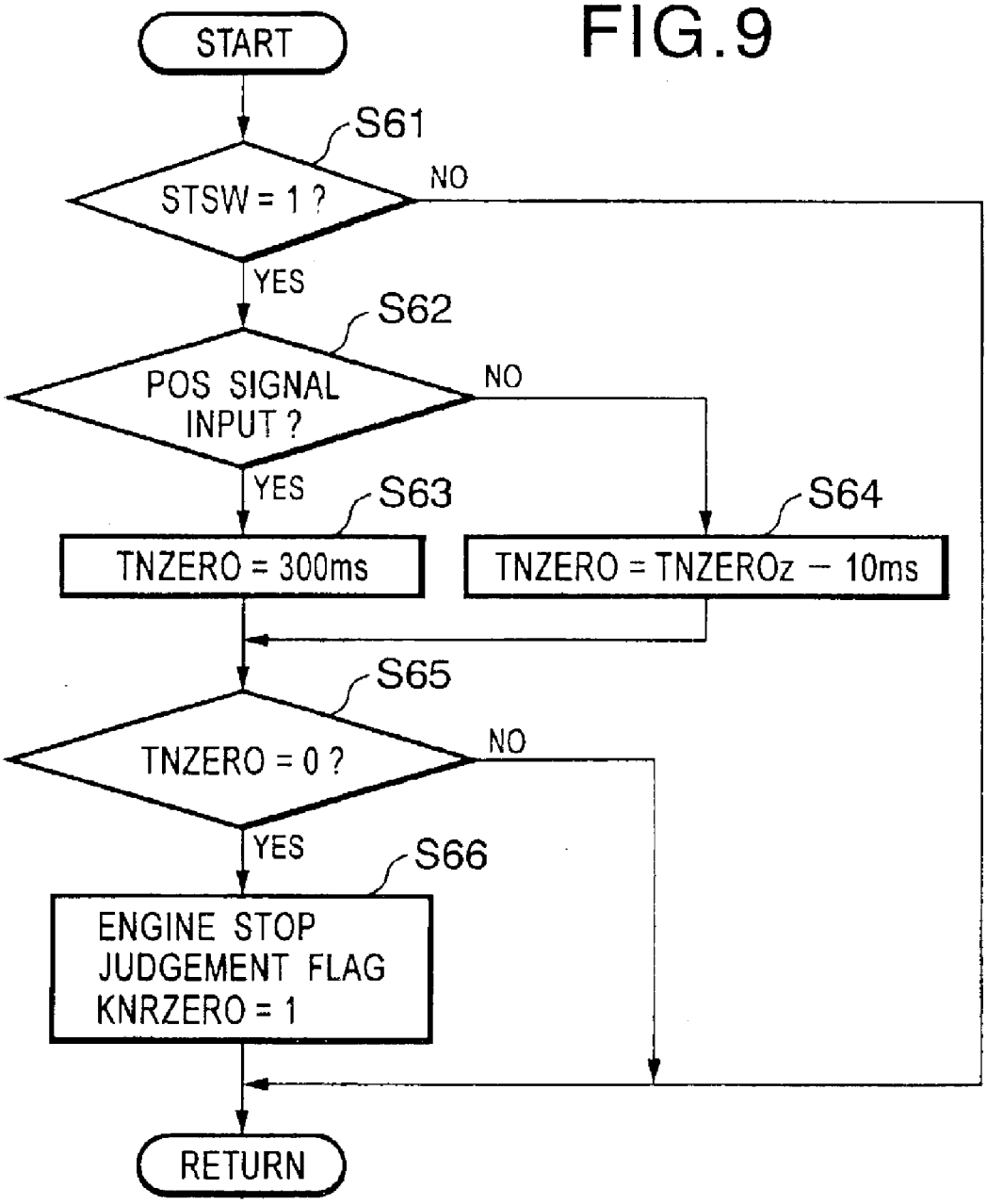
FIG. 9 is a flowchart showing a routine for an engine stop judgement flag for the engine cranking control.

FIG. 9 depicts a routine for setting a value of an engine stop judgement flag KNRZERO.

At step S 61, if the performing judgement flag STSW for the cranking control is 1, the process goes to step S 62, where the routine judges whether or not STSW is in a state immediate after the POS signal has been input. When STSW is in the state immediate after the POS signal input, the process goes to step S 63, wherein a timer TNZERO is set, and which counts an elapse time after it is set to an initial value (for example, 300 ms). Thereafter, at step S 64, the initial value continues to be subtracted by a predetermined value (for example, every 10 ms).

When, at step S 65, the value of the timer TNZERO becomes 0, namely, when the POS signal has not been input for more than a setting time (for example, 300 ms), it is judged that the engine has stopped. Then, the process moves to step S 66, wherein the engine stop judgement flag KNRZERO is set as 1. As readily understood, this setting time is set shorter than the predetermined time for which the performing judgement flag STSW for the cranking control has been set as 1.

Accordingly, if the engine stops before the continuation time judgement flag STOFF for the cranking control is set as 1, based on the engine rotation velocity not reaching the predetermined value NSTOFFA, and the battery voltage VB does not reach the predetermined value STOFFVBL, the flag STSW is set as 1.

Thereby, a control value of a cylinder identification value is initialized. As a result, defective cranking due to a control error at the next cranking time and damage to components are prevented.

Figure 10:
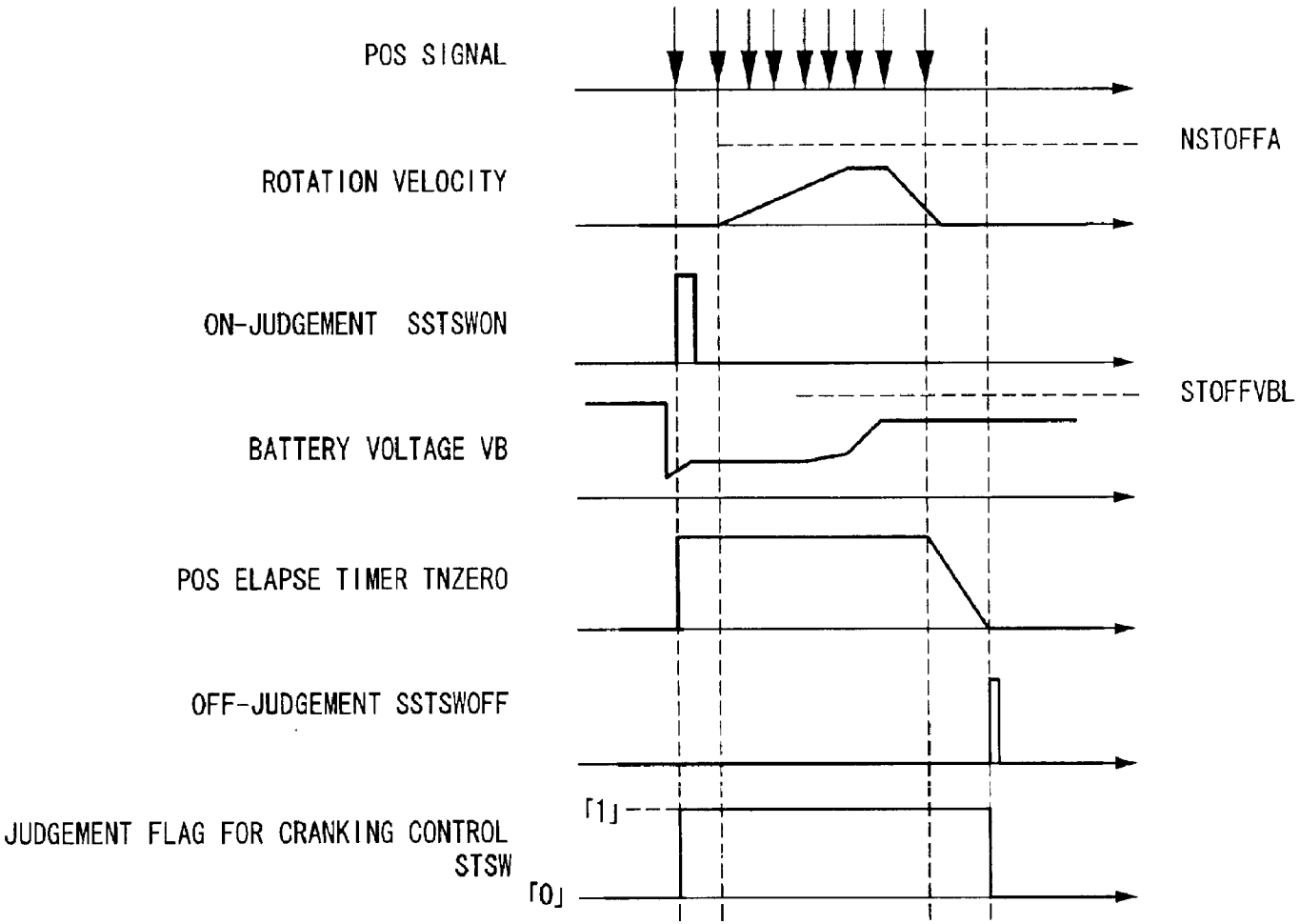
FIG. 10 is a time chart depicting when the engine stop judgement flag is set.

FIG. 10 shows a time chart for the engine stop judgement flag KNRZERO for the engine cranking control being set by detecting the engine rotation stop condition as described above.

This application claims priority to Japanese Patent Application No. 2001-400182 filed Dec. 28, 2001. The entire disclosure of Japanese Patent Application No. 2001-400182 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention is provided for illustration only, and not for the purpose of limiting the invention as defined by the appended claims and their equivalents. Moreover, features of the different embodiments may be combined.

What is claimed:

1. An apparatus for controlling an engine comprising:

a starter that cranks the engine;

a rotation velocity detector that detects an engine rotation velocity;

a battery voltage detector that detects a battery voltage for driving the starter; and a controller that performs an engine cranking control based upon the engine rotation velocity and the battery voltage, wherein the controller starts the engine cranking control when the engine is rotating, and judges that the starter is stopped if the following event occurs during the engine cranking control:

the battery voltage is lowered to at least as low as a starter drive judgment value, and then, the battery voltage is raised to at least as high as a starter stop judgment value, wherein the starter drive judgment value is smaller than the starter stop judgment value; and the controller ends the engine cranking control when judging that the starter is stopped; and wherein, when the event has not occurred, the controller ends the engine cranking control if the following event occurs:

a predetermined elapse time elapses starting when the engine cranking control is started, which predetermined elapse time elapses before battery voltage is raised to the starter stop judgment value.

2. An apparatus according to claim 1, wherein when the two events have not occurred, the controller ends the engine cranking control if the following event occurs:

a setting time representing a time that the engine rotation is not detected elapse, wherein the setting time is less than the predetermined elapse time.

3. An apparatus according to claim 2, wherein the controller tracks an amount of time that passes starting when the engine cranking control is started, and tracks an amount of time that the engine rotation is not detected.

* * * * *